US007121365B2

(12) United States Patent
Denton et al.

(10) Patent No.: US 7,121,365 B2
(45) Date of Patent: Oct. 17, 2006

(54) ROCK BIT WITH GREASE COMPOSITION UTILIZING POLARIZED GRAPHITE

(75) Inventors: Robert M. Denton, Pearland, TX (US); Alan W. Lockstedt, Houston, TX (US)

(73) Assignee: Smith International, Inc., Houston, TX (US)

( * ) Notice: Subject to any disclaimer, the term of this patent is extended or adjusted under 35 U.S.C. 154(b) by 122 days.

(21) Appl. No.: 10/744,112

(22) Filed: Dec. 23, 2003

(65) Prior Publication Data

US 2005/0133265 A1 Jun. 23, 2005

(51) Int. Cl.
*C10M 169/00* (2006.01)
*E21B 10/24* (2006.01)

(52) U.S. Cl. ..... 175/227; 175/228; 508/150; 508/155; 508/167

(58) Field of Classification Search ..... 175/57, 175/227, 228; 508/136, 144, 150, 155, 167, 508/169, 208
See application file for complete search history.

(56) References Cited

U.S. PATENT DOCUMENTS 3,062,741 A 11/1962 Crowl
3,107,878 A 10/1963 Wong
3,281,355 A 10/1966 Cyphers et al.
3,384,582 A 5/1968 Groszek
3,935,114 A 1/1976 Donaho, Jr.
4,358,384 A 11/1982 Newcomb
4,749,502 A * 6/1988 Alexander et al. ..... 508/539
5,015,401 A 5/1991 Landry et al.
5,445,748 A 8/1995 Holinski
5,589,443 A 12/1996 Denton et al.
5,668,092 A 9/1997 Denton
5,891,830 A 4/1999 Koltermann et al.
6,056,072 A 5/2000 Koltermann et al.

OTHER PUBLICATIONS

LUBOLID Friction Control Additives, Product Information by Dow Corning, 11 pages, Jan. 29, 2001.
Dr. Ruediger Holinski and Dr. Manfred Jungk, (NLGI Annual General Meeting, Oct. 23-27, 1999) New Solid Lubricants as Additive for Greases—"Polarized Graphite"—Dow Corning Corporation, pp. 1-7.
Dr. Ruediger Holinski and Dr. Manfred Jungk, New Solid Lubricants as Additive for Greases—"Polarized Graphite"—Dow Corning GmbH, (Version 2) NLGI Spokesman, Sep. 2000, vol. 64, No. 6, pp. 23-27.

* cited by examiner

*Primary Examiner*—William Neuder
(74) *Attorney, Agent, or Firm*—Christie, Parker & Hale, LLP.

(57) ABSTRACT

A lubricating grease is specific for a rock bit for drilling subterranean formations. The rock bit body includes a plurality of journal pins, each having a bearing surface, with a cutter cone mounted on each journal pin and also including a bearing surface. A grease reservoir provides lubricating grease to such bearing surfaces. The grease composition adjacent the bearing surfaces comprises a lubricating base oil, sufficient thickener and additives in the base oil to form a rock bit grease, and an effective amount of polarized graphite.

31 Claims, 1 Drawing Sheet

ROCK BIT WITH GREASE COMPOSITION UTILIZING POLARIZED GRAPHITE

FIELD OF THE INVENTION

This invention relates to a rock bit for drilling oil wells or the like including a grease composition including natural and/or synthetic lubricant basestocks and various lubricant additives, including polarized graphite, for lubricating journal bearings of the rock bit.

BACKGROUND

Heavy-duty rock bits are employed for drilling wells in subterranean formations for oil, gas, geothermal steam, and the like. Such bits have a body connected to a drill string and a plurality, typically three, of hollow cutter cones mounted on the body for drilling rock formations. The cutter cones are mounted on steel journals or pins integral with the bit body at its lower end. In use, the drill string and bit body are rotated in the bore hole, and each cone is caused to rotate on its respective journal as the cone contacts the bottom of the bore hole being drilled.

While such a rock bit is used in hard, tough formations, high pressures and temperatures are encountered. The total useful life of a rock bit in such severe environments is in the order of 20 to 200 hours for bits in sizes of about 3¾ to 36 inch diameter at depths of about 5000 to 20,000 feet. Useful lifetimes of about 65 to 150 hours are typical. When a rock bit wears out or fails as a bore hole is being drilled, it is necessary to withdraw the drill string for replacing the bit. Prolonging the time of drilling minimizes the lost time in "round tripping" the drill string for replacing bits. Replacement of a drill bit can be required for a number of reasons, including wearing out or breakage of the structure contacting the rock formation. One reason for replacing the rock bits includes failure or severe wear of the journal bearings on which the cutter cones are mounted. The journal bearings are lubricated with grease adapted to severe conditions. Lubrication failure can sometimes be attributed to misfit of bearings or seal failure, as well as problems with a grease.

The journal bearings are subjected to very high pressure drilling loads, high hydrostatic pressures in the hole being drilled, and high temperatures due to drilling as well as elevated temperatures in the formation being drilled. Considerable development work has been conducted over the years to produce bearing structures and employ materials that minimize wear and failure of such bearings.

A variety of grease compositions have been employed in the past. For example, one suitable grease composition includes a generally low viscosity, refined petroleum or hydrocarbon oil basestock which provides the basic lubricity of the composition and may constitute about ¾ of the total grease composition. Such basestock oil is thickened with a conventional metal soap or metal complex soap wherein the metal is aluminum, barium, calcium, lithium, sodium, or strontium. U.S. Pat. No. 4,358,384 discloses such a grease composition including a petroleum derived mineral oil lubricant basestock and a metal soap or metal complex soap including aluminum, barium, calcium, lithium, sodium or strontium metals.

In order to enhance the film lubricating capacity of such petroleum basestock greases, solid additives such as molybdenum disulfide, copper, lead or graphite may be added. Synthetic polymer extreme pressure agents (EPA) are also used. Such additives serve to enhance the ability of the lubricant basestock to form a film between the moving metal surfaces under conditions of extreme pressure. U.S. Pat. Nos. 4,358,384, 3,062,741, 3,107,878, 3,281,355, and 3,384,582 disclose the use of molybdenum disulfide and other solid additives such as copper, lead, silver and graphite which have been employed to attempt to enhance the lubrication properties of oils and greases. It is also known to include metallic oxides like zinc oxide or lead oxide in lubrication oils. Not all of these and other additives are suitable for use in grease compositions for the extreme conditions encountered by a rock bit. Copper and lead, for example, are now considered undesirable if they can be avoided.

It is, therefore, desirable to provide a grease composition for lubricating rock bits that protects the journal bearing surfaces from premature wear or failure during service at the high temperatures, bearing pressures and rotational speeds often found in modern rock bits. It is also desirable that the grease composition complement the sealing arrangement and promote optimum sealing.

BRIEF SUMMARY OF THE INVENTION

There is, therefore, provided in practice of this invention according to a presently preferred embodiment, a rock bit containing a grease composition for lubricating bearings of the bit. The grease composition includes natural and/or synthetic lubricating base oil and sufficient thickener and lubricant additives to form a rock bit grease, and including polarized graphite.

BRIEF DESCRIPTION OF THE DRAWINGS

A rock bit lubricated with such a grease composition is illustrated in a semi-schematic perspective in FIG. 1 and in a partial cross-section in FIG. 2.

DETAILED DESCRIPTION

In an exemplary embodiment, a rock bit includes a body 10 having three cutter cones 11 mounted on its lower end. A threaded pin 12 is at the upper end of the body for assembly of the rock bit onto a drill string for drilling oil wells or the like. A plurality of tungsten carbide inserts 13 are pressed into holes in the surfaces of the cutter cones for bearing on the rock formation being drilled. Nozzles 15 in the bit body introduce drilling mud into the space around the cutter cones for cooling and carrying away formation chips drilled by the bit.

Figure 1:
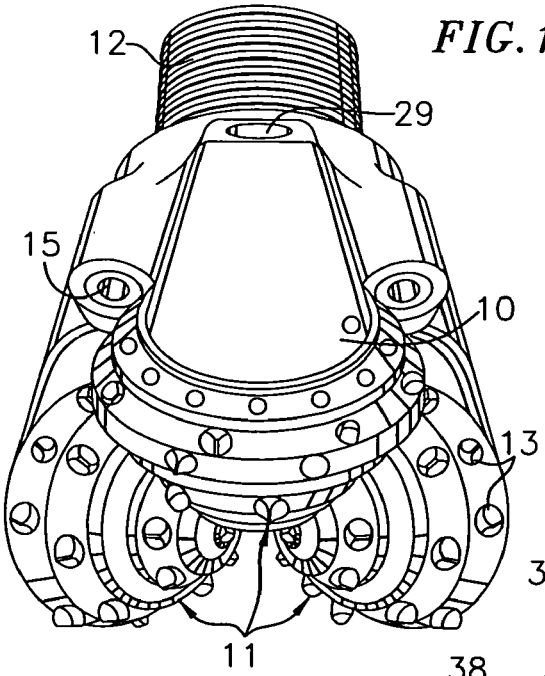
Figure 2:
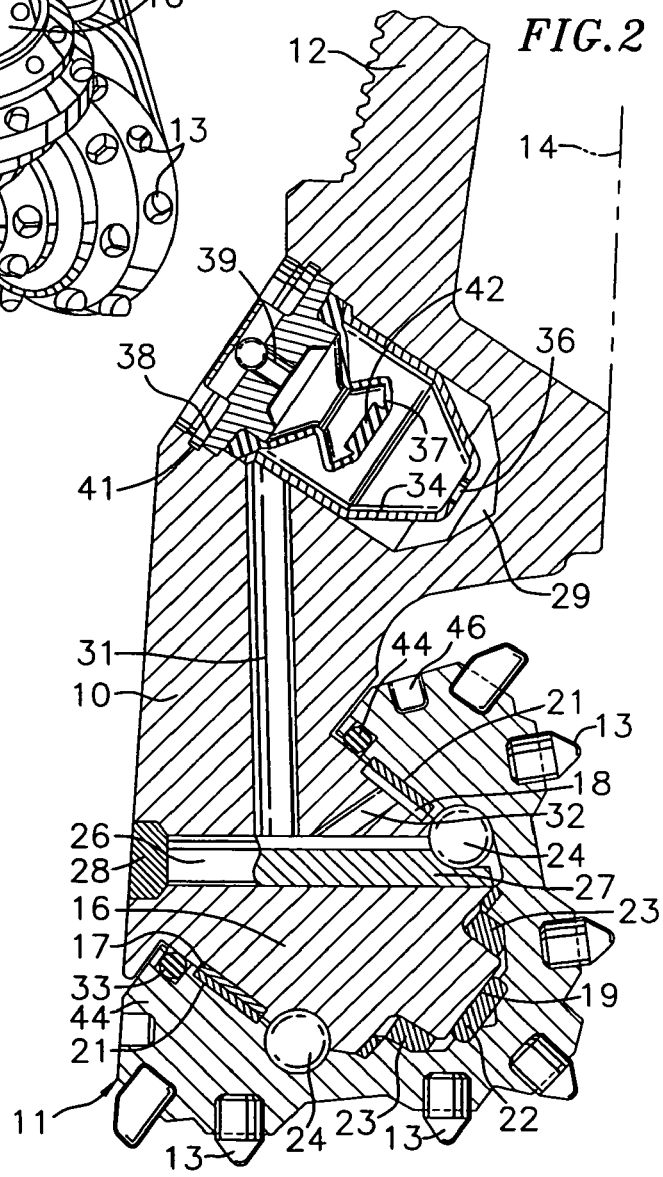

FIG. 2 is a fragmentary, longitudinal cross section of the rock bit, extending radially from the rotational axis 14 of the rock bit through one of the three legs on which the cutter cones 11 are mounted. Each leg includes a journal pin 16 extending downwardly and radially inwardly on the rock bit body. The journal pin includes a cylindrical bearing surface having a hard metal insert 17 on a lower portion of the journal pin. An open groove 18 or a smaller milled pocket is provided on the upper portion of the journal pin to aid in distribution of grease. Such a groove may, for example, extend around 60% or so of the circumference of the journal pin, and the hard metal 17 can extend around the remaining 40% or so. The journal pin also has a cylindrical nose 19 at its lower end.

Each cutter cone 11 is in the form of a hollow, generally-conical steel body having tungsten carbide inserts 13 pressed into holes on the external surface. For long life, the inserts may be tipped with a polycrystalline diamond layer. Such tungsten carbide inserts provide the drilling action by engaging a subterranean rock formation as the rock bit is rotated. Some types of bits have hard-faced steel teeth milled on the outside of the cone instead of carbide inserts.

The cavity in the cone contains a cylindrical bearing surface including an aluminum bronze or spinodal copper alloy insert 21 deposited in a groove in the steel of the cone or as a floating insert in a groove in the cone. The bronze insert 21 in the cone engages the hard metal insert 17 on the leg and provides the main bearing surface for the cone on the bit body. In this embodiment a nose button 22 is between the end of the cavity in the cone and the nose 19 to carry thrust loads of the cone on the journal pin. A bushing 23 surrounds the nose and provides additional bearing surface between the cone and journal pin and may carry the principal thrust load.

Other types of bits, particularly for higher rotational speed applications, have roller bearings instead of the exemplary journal bearings illustrated herein.

A plurality of bearing balls 24 are fitted into complementary ball races in the cone and on the journal pin. These balls are inserted through a ball passage 26, which extends through the journal pin between the bearing races and the exterior of the rock bit. A cone is first fitted on the journal pin, and then the bearing balls 24 are inserted through the ball passage. The balls carry any thrust loads tending to remove the cone from the journal pin and thereby retain the cone on the journal pin. The balls are retained in the races by a ball retainer 27 inserted through the ball passage 26 after the balls are in place. A plug 28 is then welded into the end of the ball passage to keep the ball retainer in place.

The bearing surfaces between the journal pin and cone are lubricated by a grease composition. Preferably, the interior of the rock bit is evacuated, and grease is introduced through a fill passage (not shown). The grease thus fills the regions adjacent the bearing surfaces plus various passages and a grease reservoir. The grease reservoir includes a cavity 29 in the rock bit body, which is connected to the ball passage 26 by a lubricant passage 31. Grease also fills the portion of the ball passage adjacent the ball retainer, the open groove or milled pocket on the upper side of the journal pin, and a diagonally extending passage 32 therebetween. Grease is retained in the bearing structure by a resilient seal 33 between the cone and journal pin.

A pressure compensation subassembly is included in the grease reservoir 29. This subassembly includes a metal cup 34 with an opening 36 at its inner end. A flexible rubber bellows 37 extends into the cup from its outer end. The bellows is held in place by a cap 38 with a vent passage 39. The pressure compensation subassembly is held in the grease reservoir by a snap ring 41.

When the rock bit is filled with grease, the bearings, the groove 18 on the journal pin, passages in the journal pin, the lubrication passage 31, and the grease reservoir on the outside of the bellows 37 are filled with grease. If the volume of grease expands due to heating, for example, the bellows 37 is compressed to provide additional volume in the sealed grease system, thereby preventing accumulation of excessive pressures. High pressure in the grease system can damage the seal 33 and decrease of that pressure could permit abrasive drilling mud or the like to enter the bearings. Conversely, if the grease volume should contract, the bellows can expand to prevent low pressures in the sealed grease systems, which could cause flow of abrasive and/or corrosive substances past the seal. Structure of such a rock bit is conventional and merely representative of many variations in rock bit design that are also conventional. Novelty lies in the grease compositions employed in such rock bits, and it is to be understood that the novel compositions may be used in many other configurations and variations of rock bits.

A rock bit grease composition includes natural and/or synthetic lubricating base oil, and sufficient thickener and lubricant additives to form a rock bit grease, and including polarized graphite. Either or both high and low viscosity lubricating base oils are used in rock bit grease. Sufficient thickeners are added to the base oil to form a sufficiently viscous material to function satisfactorily as a rock bit grease. Exemplary thickeners include silica gel, fumed silica or other silica powders, clay, and/or most commonly one or more metallic soaps. Complex metal soap thickeners are preferred, along with inorganic thickeners. Many additives are used in various grades of rock bit grease such as clay (to lower cost), inorganic extreme pressure materials (extreme pressure agents or EPAs), corrosion inhibitors, anti-rust agents, dyes for specific colors, inorganic anti-wear agents, adhesion polymers that are shear and temperature stable, heat stabilizers, pour point depressants, lubricious solids such as molybdenum disulfide and graphite, and sometimes metal or metal oxide particles such as lead, copper, silver, lead oxide, zinc oxide and antimony trioxide. Organic EPAs may also be utilized when selected to avoid detrimental properties such as further vulcanization of elastomeric seals, corrosive attack, incompatibility with metal complex soaps, etc. Sometimes additives are employed to cause slight swelling or softening of elastomeric seals during use of the rock bit. Examples of additives for rock bit grease compositions are well known to those skilled in the art and various examples of such materials are mentioned hereinafter in specific compositions and categories of compositions.

Greases for rock bits as described herein include polarized graphite as a lubricant additive. Unlike graphite, polarized graphite is a unique material that exhibits extremely good load carrying ability and anti-wear performance. Graphite consists of carbon in a layered structure, and the lack of polarity inhibits graphite powder from forming a lubricant film and adhering to metal surfaces. The polarization of graphite results in the material having good adhesion to metal and forming a lubricant film that can carry extremely high loads without failure.

Ordinary graphite has a laminar hexagonal crystal structure and the closed rings of carbon atoms do not normally have any electrical polarization. Hence, graphite has good lubricity in that the layers may slip or shear readily. However, the lack of polarity leads to poor adhesion to metal surfaces. Graphite can be treated with alkali molybdates and/or tungstenates, alkali earth sulfates and/or phosphates and mixtures thereof to impart a polarized layer at the surface of the graphite. Alternating positive and negative charges are apparently formed on the surfaces. The treated graphite shows extremely good load carrying capacity and anti-wear performance, somewhat similar to molybdenum disulfide. The polarized graphite has good adhesion of particles on metal surfaces and good film forming ability.

Polarized graphite is available from Dow Corning Corporation, Midland, Mich., under the trademark Lubolid. Several grades of polarized graphite are available and it has been found that Lubolid 7365 and Lubolid D-79 are satisfactory. The Lubolid D-79 grade of polarized graphite has about 2% of material that is extractable in boiling water. Additional information on polarized graphite can be found in U.S. Pat. No. 5,445,748. As stated therein, various coefficients of friction can be obtained in polarized graphite.

The addition of polarized graphite to the grease composition has been found to increase load-carrying capacity and improve anti-wear performance. The addition of polarized graphite to the grease improves the lubrication between the bearing surfaces between the journal pin and cone, as well as between the seal and adjoining metal surfaces of the leg or cone.

The adhesion properties of polarized graphite allow it to adhere to metal surfaces and create a film that serves as a physical separation between opposing metal surfaces, and between the seal and adjoining metal surfaces. Therefore, the polarized graphite, unlike graphite alone, acts as an adhesion promoter and changes the lubricity of the graphite entirely, allowing the grease composition to support much heavier loads, have a lower coefficient of friction, protect metal surfaces, and improve anti-wear performance.

The grease composition preferably includes polarized graphite in the range of from 1 to 8 percent by weight of the total grease composition. A grease composition including less than about one percent by weight of polarized graphite may have an insufficient amount of polarized graphite to provide a desired reduction in friction, wear, and abrasion. A grease composition including more than about eight percent by weight of polarized graphite does not appear to further increase the load carrying ability of the rock bit.

An exemplary grease composition includes in its synthetic fluid based including a hydrogenated polyalphaolefin synthetic hydrocarbon oil having a viscosity of 10 to 100 centistokes at 100° C. The exemplary composition also includes a thickener system for the synthetic fluid base which when added to the base forms a lubricating grease and imparts not only a gel structure to the grease but also extreme pressure and antiwear properties. The exemplary composition also includes polarized graphite in the range of from about 1 to 8 percent by weight.

A number of rock bit grease compositions benefit from use of polarized graphite in the composition. These are disclosed hereinafter in a variety of ways. Some are specific compositions and some are disclosed with ranges of ingredients. Some have listings of specific materials, sometimes by trade name, and more often by composition name. Some are disclosed as a class of material, such as, for example, an extreme pressure agent. This is appropriate since those involved in compounding greases understand these classes and know of specific materials that are suitable within such a class. Also, some embodiments are disclosed by reference to issued U.S. patents which disclose the composition.

Polarized graphite is useful in grease compositions for rock bits, such as disclosed in U.S. Pat. Nos. 3,935,114, 4,358,384, 5,015,401, 5,668,092, and 6,056,072. The subject matter of those patents is hereby incorporated by reference for disclosure of rock bit grease compositions.

A suitable grease composition may typically comprise a high viscosity refined petroleum or synthetic hydrocarbon oil which provides the basic lubricity of the composition and constitutes about three-quarters of the total grease composition. Other oils or synthetic fluids may be used such as esters, poly alpha olefins, PFPEs, flurosilicones, etc. Such a hydrocarbon oil is thickened with a conventional metal soap or metal complex soap wherein the metal is aluminum, barium, calcium, lithium, sodium or strontium. The composition also includes from about 6 to 14% by weight of molybdenum disulfide, about 4 to 10% by weight of metal soaps, about 3 to 9% by weight of copper particles (including copper with about 40% lead by weight distributed therein), and about 1 to 8% (by weight) of polarized graphite. A variety of additional ingredients may be included in the grease composition, such as extreme pressure additives, oxidation and corrosion inhibitors, dispersing agents, and the like.

For another example, a specific rock bit grease composition employing polarized graphite comprises about 26% (by weight) of heavy paraffinic residual oil, about 34 to 35% by weight of a mixture of medium viscosity index and high viscosity index petroleum oil, about 7.5 to 8% lithium complex soap, about 2% fumed silica, about 5% copper flake, about 11.5 to 12% lead naphthenate, about 7.5% molybdenum disulfide, about 1.5% polarized graphite, about 0.25% molybdenum di(2-ethylhexel) phosphorodiphthalate, about 1.5% zinc dithiocabamate, and about 2 to 2.5% extreme pressure agent (such as, for example, Hi Tech 350 available from Hi Tech Company).

Another composition employing polarized graphite comprises about 75% (by weight) of ultra-high molecular weight polyalphaolefin (Lucant 2000 from Mitsui Petrochemical, New York, N.Y.), about 10% lower molecular weight polyalphaolefin, about 1.5 to 2% polyisobutylene, about 5% of extreme pressure additive, about 3% of a friction reducing agent, such as molybdenum di(2-ethylhexel) phosphorodithilate. About 6 to 8% (by volume relative to the other ingredients) of polarized graphite, small amounts of propylene carbonate and corrosion inhibitors may also be employed in the composition.

A specific grease composition comprises about 9% by weight molybdenum disulfide, about 5% by weight copper particles, about 2% by weight aluminum complex soap, about 4 to 5% by weight lithium soap, about 2% fumed silica, and about 2% polarized graphite, with the balance of the composition being primarily a hydrocarbon oil, which is a blend of an oil having a viscosity of about 80 to 85 SUS at 210° F., and an oil having a viscosity of about 500 SUS at 210° F.

Another grease composition for lubricating rock bits comprises a substantially uniform dispersion including a heavy duty petroleum or synthetic hydrocarbon lubricant thickened by a calcium acetate complex to form a heavy duty lubricating grease that is stable at high temperatures, and has effective amounts of the solid additives of molybdenum disulfide powder, polarized graphite and metallic oxide powder, the metallic oxide being selected from the group consisting of antimony trioxide and a mixture of substantially equal parts of antimony trioxide, and other metal oxide, including zinc oxide, lead oxide, nickel oxide, tungsten trioxide, vanadium pentoxide, and copper oxide. The effective amounts of the powdered solid additives in the lubricating grease preferably includes at least 5 percent by weight of molybdenum disulfide, at least 1 percent by weight of polarized graphite and at least 5 percent by weight of the metallic oxide when employed in a rock bit. The percent by weight is based on the final weight of grease. A particularly preferred grease comprises the lubricating grease containing 8–20 percent by weight of molybdenum disulfide, 1–4 percent by weight of polarized graphite and 5–20 percent by weight of metallic oxide. Polarized graphite may be substituted for more of the molybdenum disulfide.

Another grease composition for lubricating rock bits includes high viscosity synthetic lubricant basestocks and lubricant additives for enhancing film strength and load-carrying capacity, thermal stability, oxidation resistance, corrosion resistance and thickening. An important physical property of a lubricant is its viscosity, or its resistance to flow. The viscosity of a lubrication composition determines that composition's ability to flow and form a lubricating film between opposing metal surfaces. A lubrication composition having a high viscosity generally has low flow characteristics but is a good film former once in place. A lubrication composition having a low viscosity generally has high flow characteristics but is a poor film former, especially under conditions where the opposing metal surfaces interact under conditions of extreme pressures.

The viscosity of a lubricating composition is also influenced by temperature. Generally speaking, as the temperature of lubricating composition increases, its viscosity decreases. Therefore, the composition's ability to form a lubricating film also decreases as the temperature increases. The ability of a lubricating composition to resist viscosity change as a function of changing temperature is referred to as the viscosity index (VI). A lubrication composition having a VI of 100 would exhibit relatively small changes in viscosity with temperature. A lubrication composition having a VI of 0 would exhibit a relatively large change in viscosity with temperature. Many lubricants have a low VI and are unsuitable for the extreme conditions encountered in a rock bit.

When selecting a lubricant basestock for the rock bit grease composition of the present invention it is desired that the basestock have a high viscosity and a high viscosity index in order to assure good film formation between the journal bearings throughout the temperature range of the drilling operation. For this reason, synthetic lubricant basestocks are preferred over petroleum derived basestocks.

It is desirable that the grease composition include polyisobutylene copolymer. Polyisobutylene is a highly paraffinic rubber-like hydrocarbon polymer composed of a straight chain molecule having a Flory molecular weight in the range of from 42,000 to 46,000 and high viscosity in the range of from 26,000 to 35,000 centipoise at a temperature of 350° F. (177° C.). Polyisobutylene is commercially available, for example, from the Exxon Chemical Company Polymers Group of Houston, Tex. under the product name Vistanex LM. The polyisobutylene copolymer is used to provide adhesiveness to the grease composition, enhancing its ability to cling or stick to surfaces that it comes into contact with. The polyisobutylene also provides high-temperature stability and improves the viscosity index of the grease composition.

The grease composition includes at least one other synthetic lubricant basestock selected from the group including ethylene-alphaolefins, polyalphaolefins, and mixtures thereof. An exemplary ethylene-alphaolefin is a hydrocarbon-based synthetic oil of ethylene and alphaolefin having a Flory molecular weight in the range of from 32,000 to 38,000, a Brookfield viscosity at 350° F. in the range of from 80 to 200 centipoise. An exemplary ethylene-alphaolefin has a viscosity index of approximately 300. Ethylene-alphaolefin is commercially available, for example, from Mitsui Petrochemical Industries, Ltd of Japan under the product name LUCANT 2000.

Another suitable synthetic lubricant basestock is polyalphaolefin. Polyalphaolefin is a linear alphaolefin that has undergone polymerization and hydrogenation. A suitable polyalphaolefin is commercially available, for example, from the Henkel Corporation of Cincinnati, Ohio, under the product name Emery 3004. The polyalphaolefin has a Flory molecular weight in the range of from 800 to 2000 is used primarily as a solvent for polyisobutylene to facilitate its dissolution during the preparation of the grease composition.

With respect to the lubricant additives, the grease composition may include various types of additives depending on the particular physical properties desired for the rock bit grease composition. The grease composition may include extreme pressure agents (EPA) for enhancing its film strength and load-carrying capacity. Preferred EPAs are non-metallic sulfur containing compounds such as substituted 1,3,4-thiadiazole that is commercially available, for example, from R. T. Vanderbilt Company, Inc. of Norwalk, Conn. under the product name Vanlube 829, and a non-metallic chloride-sulfur-phosphorus compound commercially available, for example, from the Lubrizol Corporation of Wickliffe, Ohio under the product name Anglamol 6063A.

The substituted 1,2,4-thiadiazole is a non-metallic powder that possesses excellent extreme pressure properties when dispersed in the synthetic lubricant basestock and also functions as an anti-wear agent and an antioxidant. The chloride-sulfur-phosphorus compound is a non-metallic liquid that possesses excellent extreme pressure properties when added to the synthetic lubricant basestock and also provides corrosion resistance to the grease composition.

The rock bit grease composition may include lubricant additives for enhancing thermal stability and oxidation resistance. An exemplary lubricant additive is an organic liquid molybdenum-sulfur-phosphorus compound commercially available from the R. T. Vanderbilt Company, Inc. of Norwalk, Conn. under the product name MOLYVAN L. The molybdenum-sulfur-phosphorus compound serves to enhance the oxidation resistance and friction characteristics of the grease composition. The liquid molybdenum-sulfur-phosphorus compound also possesses anti-wear and extreme pressure properties.

The rock bit grease composition may include lubricant additives for enhancing corrosion resistance and lowering the pour point of the grease composition. An exemplary lubricant additive is an alkyl ester copolymer compound that is commercially available, for example, from the LUBRIZOL Corporation of Wickliffe, Ohio under the product name LUBRIZOL 6662. The alkyl ester copolymer serves to depress the pour point of the grease composition, ensuring that the composition remains in liquid form and flows under operating conditions of low temperature. The alkyl ester copolymer depresses the pour point of the grease composition without affecting any other characteristics such as the viscosity or the viscosity index (VI) of the composition. The alkyl ester copolymer also serves to enhance the corrosion resistance of the grease composition.

The rock bit grease composition may include a thickening agent to transform the viscous liquid synthetic basestocks and lubricant additives to a semi-solid form. The thickening agent may be selected from the group consisting of metal complex soaps, fine silica, fine clay, fumed silica, silica gel, and the like. A feature of this grease composition is that it does not require the use of solid metal thickeners or thickening agents to provide a desired film thickness, a desired viscosity index, and a desired high viscosity. The grease composition is completely free of solid metals. The ability to form a grease composition having such film thickness, viscosity index and viscosity characteristics is rather attributed to the use of wholly synthetic lubricant basestocks, thereby eliminating the need to depend on toxic solid metals. An exemplary thickening agent is silica gel and is commercially available, for example, from Cabot Corporation of Cambridge, Mass. under the product name Cab-O-Sil M5. The silica gel serves to transform the liquid synthetic basestocks and lubricant additives to a semi-solid form. Other thickeners as mentioned above may also be used.

The rock bit grease composition includes from about 1 to 8 percent by weight of polarized graphite.

The rock bit grease composition may also include propylene carbonate. The propylene carbonate is a surfactant that facilitates the wetting of the silica gel thickening agent, thus allowing the silica gel to more readily disperse in the lubricant. A suitable propylene carbonate composition is commercially available from Texaco Chemical Company of Houston, Tex. under the product name Texacar Propylene Carbonate.

The principal portion of the grease composition includes synthetic lubricant basestocks that provide the basic lubricity. Thus, about ¾ by weight of the grease composition is such synthetic lubricant basestock. Synthetic lubricant basestocks are often preferred over petroleum derived basestocks because of their increased viscosity and high viscosity index (VI). However, high viscosity petroleum derived basestocks may also be used.

The grease composition includes synthetic lubricant basestocks in the range of from 55 to 90 percent by weight of the total grease composition. A grease composition including less than 55 percent by weight synthetic lubricant basestocks may not possess the basic lubricity required for rock bit lubrication. A grease composition including greater than 90 percent by weight synthetic lubricant basestocks will not contain the quantity of lubricant additives such as polarized graphite, EPAs, corrosion inhibitors, etc., needed to produce a grease composition having the desired degree of lubrication film strength and load-carrying capacity for operation at the high temperatures and pressures encountered in rock bit bearings.

An exemplary grease composition includes in the range of from 1 to 20 percent by weight polyisobutylene. A grease composition including less than 1 percent by weight polyisobutylene may not possess the degree of adhesiveness desired to make the grease composition adhere to metal surfaces. A grease composition including greater than 20 percent by weight of the aforementioned polyisobutylene may be too viscous to serve as a rock bit lubricant in low temperature applications. Other lower molecular weight polyisobutylenes may be used to prepare the grease composition of the present invention. However, the proportion of lower molecular weight polyisobutylene used to prepare the grease composition of the present invention would need to be increased.

In addition to the polyisobutylene, the grease composition includes at least one other synthetic lubricant basestock selected from the group consisting of ethylene-alphaolefin and polyalphaolefin.

A grease composition including ethylene-alphaolefin and polyisobutylene as synthetic lubricant basestocks includes in the range of from 50 to 90 percent by weight ethylene-alphaolefin and in the range of from 1 to 20 percent by weight polyisobutylene. An exemplary grease composition including polyalphaolefin and polyisobutylene includes approximately 40 percent by weight polyalphaolefin and in the range of from 1 to 20 percent by weight polyisobutylene.

A grease composition including ethylene-alphaolefin, polyalphaolefin and polyisobutylene as synthetic lubricant basestocks includes in the range of from 50 to 90 percent by weight ethylene-alphaolefin, up to about 40 percent by weight polyalphaolefin, and in the range of from 1 to 20 percent by weight polyisobutylene. An exemplary grease composition includes approximately 76 percent by weight ethylene-alphaolefin, 6 percent by weight polyalphaolefin and 2 percent by weight polyisobutylene, plus the polarized graphite and other additives such as EPAs, etc.

A grease composition including less than 50 percent by weight ethylene-alphaolefin may not possess the basic lubricity required for a rock bit lubricant. A grease composition including greater than 90 percent by weight ethylene-alphaolefin does not contain an adequate amount of lubricant additives. A grease composition including greater than 40 percent by weight polyalphaolefin excessively. diminishes the viscosity of the lubricant and does not have the fluid film forming capability needed for a rock bit lubricant.

The grease composition is prepared by combining the synthetic lubricant basestocks in the preferred proportions with various lubricant additives. The grease composition preferably includes in the range of from 5 to 45 percent by weight various lubricant additives, including polarized graphite.

The grease composition may include extreme pressure agents such as substituted 1,2,4-thiadiazole and a chloride-sulfur-phosphorus compound. The grease composition also includes in the range of from 0.1 to 25 percent by weight substituted 1,2,4-thiadiazole and in the range of from 1 to 10 percent by weight the chloride-sulfur-phosphorus compound. A preferred grease composition includes approximately 3 percent by weight substituted 1,2,4-thiadiazole and approximately 5 percent by weight the chloride-sulfur-phosphorus compound.

Another composition employing polarized graphite comprises about 75% (by weight) of ultra-high molecular weight polyalphaolefin (Lucant 2000 from Mitsui Petrochemical, New York, N.Y.), about 10% lower molecular weight polyalphaolefin, about 1.5 to 2% polyisobutylene, about 5% of extreme pressure additive, about 3% of a friction reducing agent, such as molybdenum di(2-ethylhexel) phosphorodiphthalate. About 3 to 8% (by volume relative to the other ingredients) of polarized graphite, small amounts of propylene carbonate and corrosion inhibitors may also be employed in the composition.

Another composition employing polarized graphite comprises about 75% (by weight) of ultra-high molecular weight polyalphaolefin about 6% lower molecular weight polyalphaolefin, up to about 3% polyisobutylene, about 5% of multipurpose extreme pressure performance additive (e.g. Anglamol 6063A), up to about 3% of a friction reducing agent, such as molybdenum di(2-ethylhexel) phosphorodithilate, about 5% of silica and a small amount of other additives such as a corrosion inhibitor. About 3 to 8% (by volume relative to the other ingredients) of polarized graphite, small amounts of propylene carbonate and corrosion inhibitors may also be employed in the composition.

Another exemplary solid extreme pressure agent is hexagonal boron nitride (hBN) powder. The hBN powder is combined with the synthetic polymer lubricant basestocks and the complex soap base as an extreme pressure additive for enhancing the film strength and load carrying capacity of the grease composition. The hBN powder can have nearly any particle size and/or particle size distribution. It is desired that approximately 99 percent of the hBN particles have an average particle size of minus 325 mesh. A particularly preferred hBN powder is commercially available, for example, from Advanced Ceramics Corporation of Cleveland, Ohio as grade HCLP hBN powder, having a mean particle size of in the range of from 8 to 11 micrometers, an average surface area of approximately 7 meters2/g, and an average density of approximately 0.5 g/cc.

It is desired that the grease composition include in the range of from 1 to 5 percent by weight hBN powder. Polarized graphite may substitute for part or all of the hBN or may be added to this amount of hBN. In an exemplary embodiment, the grease composition includes approximately two percent by weight of the hBN powder and one percent by weight polarized graphite.

The grease composition may also include a lubricant additive for enhancing the thermal stability and oxidation resistance of the synthetic lubricant basestock. For example, the grease composition includes a molybdenum-sulfur-phosphorus compound in the range of from 1 to 10 percent by weight of the total grease composition. A preferred grease composition includes approximately 3 percent by weight the molybdenum-sulfur-phosphorus compound.

The rock bit grease composition additionally may include about 5 to 10 percent by weight molybdenum disulfide (MoS2) lubricant additive, in addition to polarized graphite. The MoS2 is used in forming the grease composition because of its excellent lubricating properties, acting together with hBN and polarized graphite to produce a grease composition having a desired degree of load carrying capability and lubricity. In an exemplary embodiment, the grease composition includes approximately five percent by weight of the MoS2 ingredient and two percent by weight of polarized graphite.

The grease composition may also include additives for enhancing corrosion resistance and lowering the pour point of the grease composition. For example, the grease composition may include an alkyl ester copolymer in the range of from 0.1 to 5 percent by weight of the total grease composition to control pour point. As little as approximately 0.3 percent by weight alkyl ester copolymer should be enough.

The grease composition preferably includes a thickening agent such as silica gel or fumed silica in the range of from 2 to 8 percent by weight of the total grease composition. One such grease composition includes approximately 5 percent by weight silica gel. A metal complex soap may also be a suitable thickener in some embodiments.

The grease composition may include propylene carbonate in the range of from 0.1 to 3 percent by weight of the total grease composition to enhance wetting and suspension of the silica gel thickening agent and other solids.

An exemplary grease composition was prepared and tested to evaluate the load carrying ability of the grease. The grease composition was prepared by combining approximately 76.50 percent by weight LUCANT 2000, approximately 6.00 percent by weight polarized graphite, approximately 6.00 percent by weight MoS2, approximately 4.75 percent by weight silica gel thickener, approximately 3.45 percent by weight alkyl ester copolymer, approximately 1.75 percent by weight polyisobutylene, approximately 1.25 percent by weight hexagonal boron nitride, and approximately 0.30 percent by weight propylene carbonate.

Samples of the grease composition that were prepared according to the above-described example were subjected to four ball testing, according to ASTM D-2596, to evaluate the load bearing capability of the grease. Conventional rock bit grease compositions display a four ball test load of approximately 620 kilograms (kg). A grease composition having a four ball test load of 620 Kg is one that is incapable of preventing the welding together of at least two balls when subjected to a load of 620 Kg for a period of 10 seconds. The exemplary grease composition displayed a four ball test load of at least approximately 1000 kg, which demonstrates the superior load bearing capability of such grease composition when compared with conventional-type grease compositions.

Another rock bit grease composition improved by use of polarized graphite comprises a synthetic fluid base, and a thickener system for the synthetic fluid base which, when added to the base, forms a lubricating grease with sufficiently improved properties to be stable at downhole temperatures and pressures so as to be useful in rock bits drilling in hot subterranean formations. A preferred synthetic fluid base is selected from the group consisting of synthetic hydrocarbon fluids, polyol esters, synthetic polyethers, alkylene oxide polymers and interpolymers, esters of phosphorous containing acids, silicon based oils and mixtures of the above. A particularly preferred synthetic fluid base is a hydrogenated polyalphaolefin synthetic hydrocarbon oil or a mixture of such oil with a polyol ester fluid.

The thickener systems include calcium complex soap thickeners in which calcium hydroxide and acetic acid are two of the reactants forming the thickener, as well as other metal soap thickeners, their complexes and mixtures thereof in combination with calcium acetate which is either added or formed in the synthetic fluid base. A thickener system may also include non-soap thickeners such as silica gellants or clays and mixtures thereof combined with calcium acetate.

A preferred metal complex soap thickener is a fatty acid complex formed by the reaction of calcium hydroxide with several organic acids of which one is acetic acid and the others of which are higher molecular weight organic acids. Other thickener systems include metal soap thickeners and their complexes in combination with calcium acetate, wherein the metal is selected from the group consisting of aluminum, barium, calcium, lithium, sodium, and strontium.

Other thickener systems are inorganic thickeners such as silica gellant thickeners, conventional modified clay thickeners, dye and pigment thickeners and other inert type thickeners such as carbon black, graphite, polytetrafluoroethylene (PTFE) in combination with calcium. acetate. Traditional solid lubricant packages and other oil soluble performance enhancing additives can also be included in the rock bit grease formulations.

One class of synthetic fluid bases is that of synthetic polyolefins, particularly hydrogenated polyalphaolefins, although other synthetic polyolefins may be utilized as well. Examples of the synthetic hydrocarbon oils which may be utilized as the synthetic fluid bases are saturated and are thus prepared by polymerizing unsaturated monomers (e.g., ethylene) and are hydrogenated prior to use to remove any unsaturation from the synthetic oil.

Examples of the saturated hydrocarbon oils, which include halo-substituted hydrocarbon oils, are the hydrogenated polymerized and interpolymerized olefins such as fluid polyethylenes, polypropylenes, polybutylenes, propylene-isobutylene copolymers, chlorinated polybutylenes, poly(1-hexenes), poly(1-octenes), poly(1-decenes); polymers of alkyl benzenes, such as dodecylbenzenes, tetradecylbenzenes, dinonylbenzenes, di-(2-ethyl-hexyl)-benzenes, etc.; polyphenyls such as biphenyls, terphenyls, alkylated polyphenyls, etc.; alkylated diphenyl ethers and alkylated diphenyl sulfides and the derivatives, analogs and homologs thereof. Also included are deuterated synthetic hydrocarbon oils. The hydrogenated polyolefins derived from alpha aliphatic olefins such as ethylene, propylene, 1-butene, etc. are preferred examples of polyolefins useful as the synthetic fluid base.

Synthetic fluid base polyol polyesters are obtained by reacting various polyhydroxy compounds with carboxylic acids. When the carboxylic acids are dicarboxylic acids, mono-hydroxy compounds can be substituted for the polyols. For example, useful synthetic esters include esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc. with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-N-hexyl fumarate, dioctyl sebacate, diisooctyl azelate, diisodecyl azelate, dioctyl phthalate, didecyl phthalate, etc.; and esters of trimethylol propane, trimethylol butane, trimethylol ethane, pentaerythritol and/or dipentaerythritol with one or more monocarboxylic acids containing from about 5 to 10 carbon atoms.

Examples of esters of phosphorous containing acids which are useful as the synthetic fluid bases in a rock bit grease include triphenyl phosphate, tricresyl phosphate, trixylyl phosphate, trioctyl phosphate, diethyl ester of decane phosphonic acid, etc.

Silicon-based oils such as the polyalkyl-, polyaryl-, polyalkoxy-, and polyaryloxy-siloxane oils and silicate oils comprise another useful class of synthetic base fluids and will be familiar to those skilled in the art. Examples of the silicate oils include tetraethyl silicate, tetraisopropyl silicate, tetra-(2-ethylhexyl) silicate, tetra-(4-methyl-hexyl) silicate and tetra-(p-t-butyl-phenyl) silicate. In one preferred embodiment, the silicon-based oils are polysilicones such as alkyl phenyl silicones or siloxanes. Alkyl phenyl silicones and the like which are useful in rock bit grease may have kinematic viscosities ranging from about 20 to about 2000 centistokes at 25° C. Additional specific materials, properties and examples are found in U.S. Pat. No. 6,056,072.

Another exemplary grease containing polarized graphite comprises a multi-purpose heavy duty or high viscosity hydrocarbonaceous lubricant base oil thickened by an alkaline soap to form a lubricating grease, and a combination of powdered molybdenum disulfide and powdered calcium fluoride plus polarized graphite. The proportions of molybdenum disulfide and calcium fluoride are in the range of from about 1:6 to 6:1. Such a grease contains about 3 to 30% by weight of the grease of total solids, i.e., polarized graphite, molybdenum disulfide and calcium fluoride. Other anti-corrosion, anti-oxidation, anti-wear, etc., grease additives may also be included.

A suitable grease composition is made from a base high viscosity, refined petroleum or hydrocarbon oil (or a synthetic oil) which is thickened with an alkaline metal soap or metal soap complex, wherein the metal is typically aluminum, barium, calcium, lithium, sodium or strontium, for example, a calcium complex, such as calcium acetate. Typically, the lubricating grease has an ASTM D-217 test, in depths of penetration in tenths of a millimeter in 5 seconds at 77° F., of no less than 265. The lubricating grease falls in the NLGI class 00, class 0, class 1, or class 2. The grease is stable at temperatures up to at least 300° F.

The solid particles of polarized graphite, molybdenum disulfide and calcium fluoride can be incorporated into the grease at almost any stage in the manufacture of the final product, depending upon the convenience with respect to the particular manufacturer. For example, they can be incorporated when the thickener is added; or, ordinarily they can be incorporated at some stage in the handling of the semi-finished product. An important feature is that sufficient mixing should be employed; as by working, homogenizing, or otherwise; to secure a complete, uniform, and thorough dispersion of the particles of the molybdenum disulfide and the calcium fluoride throughout the grease.

A grease that is satisfactory for lubricating a rock bit has from about 1–8% by weight of polarized graphite, about 1–20% by weight of powdered molybdenum disulfide and from about 1–20% by weight of powdered calcium fluoride. Preferably, the total solids content of the grease (weight percent powdered polarized graphite, molybdenum disulfide and calcium fluoride) is from about 3–30% by weight of the grease.

An exemplary metal particle-containing-grease composition contains about 3 to 9% by weight of copper particles smaller than about 325 mesh (44 microns). The copper can be in the form of spheres, granules or leafing flake or can comprise composite granules also containing lead. In the latter form the copper is physically mixed with lead to form a two phase composite of pure copper as a continuous phase with pure lead distributed as a discontinuous phase in the copper. A suitable mix has a composition of about 60% copper and 40% lead by weight. This composite is considered to be copper in practice of this invention since it behaves like copper in a rock bit rather than like lead. Silver may also be used. The composition also comprises about 1 to 8% by weight polarized graphite and about 6 to 14% by weight of molybdenum disulfide particles smaller than about 325 mesh. The molybdenum disulfide and polarized graphite particles can be appreciably smaller (e.g. seven microns) since the lubricating effect appears to be independent of particle size and continues even when particle size is appreciably reduced during use of the grease.

If the proportion of copper is less than about 3% by weight, insufficient copper can be present to protect the bearings or provide prolonged life of molybdenum disulfide. If the molybdenum disulfide is present as less than about 6% by weight, the particles may be prematurely disintegrated and lose effectiveness in the grease composition, although presence of higher amounts of polarized graphite offsets this effect and a lower proportion of molybdenum disulfide is considered equivalent.

When the proportions of powders are too high in the grease composition, the flow properties of the grease are adversely affected and the ability to lubricate, particularly at lower temperatures can be degraded. Thus, if the copper powder is present in a proportion more than about 9% by weight, the proportion of other powders should be decreased.

As in most greases, the principal portion of the composition is a refined petroleum or synthetic oil which provides the basic lubricity. Thus, about ¾ by weight of the composition is such a mineral or synthetic oil, preferably a paraffinic material for its good lubricity and resistance to elevated temperature decomposition. In an exemplary embodiment, a suitable lubricant oil basestock comprises a blend of about equal portions of an oil with a viscosity at 210° F. of about 500 Saybolt Universal Seconds (SUS) and an oil having a viscosity at 210° F. to about 80 to 85 SUS.

The grease composition includes a thickener for thickening the oil to an extent that it can readily retain the solid additives in suspension. Such a thickener is preferably a combination of two metal soaps or metal complex soaps wherein the metal is selected from the group consisting of aluminum, barium, calcium, lithium, sodium, and strontium. Such metal soaps are readily available and widely used in grease compositions. In particular, it is preferred that the metal soap comprise a combination of a lithium soap and either an aluminum complex soap or a calcium complex soap.

Typically, the metal soaps are present in the range of from about 4 to 10% by weight. If the metal soaps are present in a proportion less than about 4% by weight, there can be insufficient thickening for maintaining the solid additive particles in suspension and distributing the particles adjacent the bearing surfaces. If the proportion of metal soaps is more than about 10% by weight, excessive stiffness of the grease can occur, particularly with a high viscosity oil base. If desired, the composition can also include inert thickeners such as silica powder. Such inert filler can help maintain active solid additives in suspension, particularly at elevated temperatures. If the proportion of silica is more than about 4% by weight, reductions in other solids may be required to maintain a suitable consistency in the grease.

A variety of additional ingredients can be included in the grease composition; in particular it can be desirable to include extreme pressure additives, sometimes known as film strength additives. A variety of conventional extreme pressure agents which undergo chemical reaction with the metal surfaces and prevent metal to metal contact and scoring are well known in the art. Such agents are commonly compounds containing chlorine, phosphorous, and/or sulfur. Various chlorinated waxes, organic phosphites and phosphates, and sulfur containing unsaturated organic compounds are employed. Various organo-zinc and organo-lead compounds may also be employed. Other ingredients included in the grease composition can include oxidation and corrosion inhibitors, dispersants and the like.

A specific grease composition of this type for lubricating a rock bit comprises about 9 to 11% by weight molybdenum disulfide particles, about 5% by weight copper particles, about 6% by weight polarized graphite, about 2% by weight lithium complex soap, about 4 to 5% by weight lithium soap (variations of lithium and lithium complex soaps are suitable), about 2% by weight silica powder, and a balance of primarily hydrocarbon oil. The grease can also include oxidation and corrosion inhibitors, extreme pressure agents and the like in effective amounts. The hydrocarbon oil is a blend of predominantly naphthenic and a lesser amount of paraffinic oils present as about ¾ of the composition.

Another suitable rock bit grease comprises a substantially uniform dispersion including a multi-purpose heavy duty hydrocarbonaceous lubricant thickened by a calcium acetate complex to form a heavy duty lubricating grease that is stable at high temperatures and that has an American Society for Testing Materials (ASTM) worked penetration no less than 265; and effective and synergistic amounts of the solid additives of polarized graphite, and metallic oxide powder selected from the group consisting of antimony trioxide ($Sb_2O_3$); and a mixture of substantially equal parts of antimony trioxide, zinc oxide (ZnO), lead oxide (PbO), nickel oxide ($Ni_2O_3$), tungsten trioxide ($WO_3$), vanadium pentoxide ($V_2O_5$) and copper oxide (CuO/$Cu_2O$), and optionally molybdenum disulfide ($MoS_2$) powder. The effective and synergistic amounts of the powdered solid additives in the lubricating grease includes about 1 to 8 percent by weight of polarized graphite, 7 to 20 percent by weight of molybdenum disulfide and about 5 to 20 percent by weight of the metallic oxide when employed in a rock bit. The percent by weight is based on the final weight of grease. Additional specific materials, properties and examples of such a rock bit grease composition are found in U.S. Pat. No. 3,935,114.

There are also conventional rock bit grease compositions containing solid lubricating additives of molybdenum disulfide, graphite and/or hexagonal boron nitride. Polarized graphite can be substituted for the molybdenum disulfide, graphite and/or hexagonal boron nitride on an approximately one-for-one basis, and the performance of the grease will be enhanced as compared with the unsubstituted rock bit grease composition. For example, if a conventional unsubstituted rock bit grease composition has 5% ordinary graphite or molybdenum disulfide, the graphite or molybdenum disulfide can be replaced with about 5% of polarized graphite. Since the polarized graphite may be more effective, a somewhat smaller amount of polarized graphite may be sufficient.

One such conventional hexagonal boron nitride-containing grease for lubricating rock bit bearings comprises high viscosity synthetic polymer lubricant basestocks or petroleum derived lubricant basestocks and lubricant additives for enhancing film strength and load carrying capacity, thermal stability, oxidation resistance, corrosion resistance and thickening. An exemplary grease composition is prepared by combining synthetic polymer lubricant basestocks comprising at least one ethylene-alphaolefin and a polyisobutylene or isobutylene copolymer to form a lubricious base. A complex metal soap thickener is included, along with lubricant additives, if desired, for enhancing film strength and load-carrying capacity, thermal stability, oxidation resistance and corrosion resistance, and for thickening the lubricant basestocks. An effective amount of hexagonal boron nitride (hBN) extreme pressure agent is included since it has a crystal structure and properties similar to that the graphite. Polarized graphite can be substituted for the hBN or can be substituted for a portion of the hBN. Exemplary conventional compositions have from 1 to 5 percent by weight hBN and from 1 to 8% polarized graphite can be substituted for some or all of the hBN.

In addition to the specific features and embodiments described above, it is understood that the present invention includes all equivalents to the structures and features described herein, and is not to be limited to the disclosed embodiments. For example, the specific percentages by weight for each of the compositions in the grease composition can be varied depending on the particular application, as can the embodiments of the exemplary rock bit. Additionally, individuals skilled in the art to which the present grease composition pertains will understand that variations and modifications to the embodiments described can be used beneficially without departing from the scope of the invention.

What is claimed is:

1. A rock bit for drilling subterranean formations comprising:

a bit body including a journal pin having a bearing surface;

a cutter cone mounted on the journal pin and including a bearing surface;

a grease reservoir in communication with such bearing surfaces; and a grease composition in the grease reservoir and adjacent the bearing surfaces comprising, from about 1 to 8 percent by weight polarized graphite;

in the range of from about 55 to 95 percent by weight synthetic lubricant basestocks;

in the range of from about 5 to 10 percent by weight molybdenum disulfide, and in the range of from about 1 to 5 percent by weight hexagonal boron nitride.

2. A rock bit according the claim 1 wherein the grease composition comprises:

a synthetic fluid base comprising a hydrogenated polyalphaolefin synthetic hydrocarbon oil having a viscosity of 10 to 100 centistokes at 100° C.;

a thickener system for the synthetic fluid base which when added to the base forms a lubricating grease and imparts not only gel structure to the grease but also extreme pressure and antiwear properties; and in the range of from about 1 to 8 percent by weight polarized graphite.

3. A rock bit according to claim 2 wherein the hydrocarbon oils are in combination with polyol ester fluid.

4. A rock bit according to claim 2 wherein the synthetic fluid base is selected from the group consisting of synthetic hydrocarbon fluids, polyol esters, deuterated synthetic hydrocarbons, dimer acids, synthetic polyethers and synthetic fluorinated polyethers, alkylene oxide polymers and interpolymers, esters of phosphorus containing acids, silicon based oils and mixtures of thereof.

5. A rock bit according to claim 2 wherein the thickener consists of silica gellant and calcium acetate.

6. A rock bit according to claim 5 wherein the calcium acetate is formed in the synthetic fluid base by reaction of calcium hydroxide and acetic acid.

7. A rock bit according to claim 1 wherein the grease composition is free of solid metal particles and has a viscosity index in the range of from 250 to 325 and wherein the synthetic lubricant basestocks comprise in the range of from about 1 to 20 percent by weight polyisobutylene having a Flory molecular weight in the range of from 42,000 to 46,000, in the range of from about 50 to 90 percent by weight ethylene-alphaolefin having a Flory molecular weight in the range of from 32,000 to 38,000, and up to about 40 percent by weight polyalphaolefin having a molecular weight in the range of from 800 to 2,000, and wherein the grease composition further comprises a lubricant additives comprising a 1,3,4-thiadiazole compound, a sulfur-chloride-phosphorus compound, an alkyl ester copolymer, a silica gel compound, and a propylene carbonate compound.

8. A rock bit according to claim 7 wherein the grease composition comprises 1,3,4-thiadiazole compound in the range of from 0.1 to 25 percent by weight, sulfur-chloride-phosphorus compound in the range of from 1 to 10 percent by weight, molybdenum-sulfur-phosphorus compound in the range of from 1 to 10 percent by weight, alkyl ester copolymer in the range of from 0.1 to 5 percent by weight, silica gel in the range of from 2 to 8 percent by weight, and wherein the grease composition has an absolute viscosity greater than about 100,000 centipoise at a temperature of 70.degree. F. and at a shear rate less than 40 seconds-1.

9. A rock bit according to claim 1 wherein the rock bit comprises a plurality of journal pins, each having a bearing surface, and a cutter cone mounted on each journal pin and including a bearing surface, wherein the grease reservoir is in communication with such bearing surfaces, and wherein the grease composition is adjacent the bearing surfaces.

10. A rock bit for drilling subterranean formations comprising:

a bit body including a journal pin having a bearing surface;

a cutter cone mounted on the journal pin and including a bearing surface;

a grease reservoir in communication with such bearing surfaces; and a grease composition in the grease reservoir and adjacent the bearing surfaces comprising, copper particles in the range of from 3 to 9% by weight, molybdenum disulfide particles in the range of from 6 to 14% by weight, polarized graphite in the range of from 1 to 8% by weight, and a metal soap wherein the metal is selected from the group consisting of aluminum, barium, calcium, lithium, sodium and strontium, and mixtures thereof, and a balance of primarily hydrocarbon oil.

11. A rock bit according to claim 10 wherein the metal soap in the grease composition comprises a mixture of two metal soaps and the metal is selected from the group consisting of aluminum, calcium, lithium, and sodium.

12. A rock bit according to claim 10 wherein the molybdenum disulfide in the grease composition is present in a proportion of about 11% by weight, the copper is present in a proportion of about 5% by weight and the metal soap comprises a mixture of a lithium soap and a calcium complex soap or an aluminum complex soap, said mixture being present in the range of from about 4 to 10% by weight.

13. A rock bit for drilling subterranean formations comprising:

a bit body including a journal pin having a bearing surface;

a cutter cone mounted on the journal pin and including a bearing surface;

a grease reservoir in communication with such bearing surfaces; and a grease composition in the grease reservoir and adjacent the bearing surfaces comprising, about 75% of ultra-high molecular weight polyalphaolefin, about 10% lower molecular weight polyalphaolefin, about 1.5 to 2% polyisobutylene, about 5% of extreme pressure additive, about 3% of a friction reducing agent, and about 6 to 8% (by volume relative to the other ingredients) of polarized graphite.

14. A rock bit for drilling subterranean formations comprising:

a bit body including a journal pin having a bearing surface;

a cutter cone mounted on the journal pin and including a bearing surface;

a grease reservoir in communication with such bearing surfaces; and a grease composition in the grease reservoir and adjacent the bearing surfaces comprising, about 75% (by weight) of ultra-high molecular weight polyalphaolefin, about 6% lower molecular weight polyalphaolefin, up to about 3% polyisobutylene, about 5% of extreme pressure additive, up to about 3% of a friction reducing agent, about 5% of silica, and about 3 to 8% (by volume relative to the other ingredients) of polarized graphite.

15. A rock bit for drilling subterranean formations comprising:

a bit body including a journal pin having a bearing surface;

a cutter cone mounted on the journal pin and including a bearing surface;

a grease reservoir in communication with such bearing surfaces; and a grease composition in the grease reservoir and adjacent the bearing surfaces comprising, a multi-purpose heavy duty hydrocarbonaceous lubricant thickened by an alkaline soap to form a lubricating grease, from about 1 to 8% by weight of polarized graphite, from about 1 to 20% by weight of powdered molybdenum disulfide, and from about 1 to 20% by weight of powdered calcium fluoride, the weight percent ratio of powdered molybdenum disulfide to powdered calcium fluoride being in the range from about 1:6 to 6:1.

16. A rock bit for drilling subterranean formations comprising:

a bit body including a journal pin having a bearing surface;

a cutter cone mounted on the journal pin and including a bearing surface;

a grease reservoir in communication with such bearing surfaces; and a grease composition in the grease reservoir and adjacent the bearing surfaces comprising, a multi-purpose heavy duty hydrocarbonaceous lubricant thickened by an alkaline soap to form a lubricating grease, from about 1 to 8% by weight of polarized graphite, from about 1 to 20% by weight of powdered molybdenum disulfide, and from about 1 to 20% by weight of powdered calcium fluoride present in an effective amount, to produce a lubricating grease that is stable at temperatures up to at least 300° F. and having an ASTM worked penetration of no less than 265, and wherein the total solids content of the lubricating grease is in the range from about 3–30% by weight of the grease.

17. A rock bit for drilling subterranean formations comprising:

a bit body including a journal pin having a bearing surface;

a cutter cone mounted on the journal pin and including a bearing surface;

a grease reservoir in communication with such bearing surfaces; and a heavy duty lubricating grease composition in the grease reservoir and adjacent the bearing surfaces comprising a substantially uniform dispersion including, a multi-purpose heavy duty hydrocarbonaceous lubricant thickened by a calcium acetate complex to form a lubricating grease, and effective amounts of:

polarized graphite, powdered metallic oxide selected from the group consisting of antimony trioxide, zinc oxide, lead oxide, nickel oxide, tungsten trioxide, vanadium pentoxide and copper oxide, and powdered molybdenum disulfide.

18. A rock bit according to claim 17 wherein the polarized graphite is present in the range of from 1 to 8 parts by weight.

19. A rock bit according to claim 17 wherein said metallic oxide comprises a mixture of antimony trioxide, zinc oxide, lead oxide, nickel oxide, tungsten trioxide, vanadium pentoxide and copper oxide; said metallic oxide particles being small enough to pass 100 percent through a 100 mesh screen and 90 percent through a 325 mesh screen.

20. A rock bit for drilling subterranean formations comprising:

a bit body including a journal pin having a bearing surface;

a cutter cone mounted on the journal pin and including a bearing surface;

a grease reservoir in communication with such bearing surfaces; and a heavy duty lubricating grease composition in the grease reservoir and adjacent the bearing surfaces comprising a substantially uniform dispersion including, a multi-purpose heavy duty hydrocarbonaceous lubricant thickened by a calcium acetate complex to form a lubricating grease, particles of molybdenum disulfide that are small enough to pass 100 percent through a 100 mesh screen and 85 percent through a 325 mesh screen, and particles of antimony trioxide that are small enough to pass 100 percent through a 100 mesh screen and 90 percent through a 325 mesh screen, and effective amounts of:

polarized graphite, and powdered metallic oxide selected from the group consisting of antimony trioxide, zinc oxide, lead oxide, nickel oxide, tungsten trioxide, vanadium pentoxide and copper oxide.

21. A rock bit for drilling subterranean formations comprising:

a bit body including a journal pin having a bearing surface;

a cutter cone mounted on the journal pin and including a bearing surface;

a grease reservoir in communication with such bearing surfaces; and a heavy duty lubricating grease composition in the grease reservoir and adjacent the bearing surfaces comprising a substantially uniform dispersion including, a multi-purpose heavy duty hydrocarbonaceous lubricant thickened by a calcium acetate complex to form a lubricating grease, molybdenum disulfide in an amount within the range of 7 to 20 percent by weight and metallic oxide in an amount within the range of 5 to 20 percent by weight, and effective amounts of:

polarized graphite, and powdered metallic oxide selected from the group consisting of antimony trioxide, zinc oxide, lead oxide, nickel oxide, tungsten trioxide, vanadium pentoxide and copper oxide.

22. A method for lubricating a rock bit for drilling subterranean formations comprising operating the bit containing a grease composition comprising:

a lubricating base oil;

sufficient thickener and additives in the base oil to form a rock bit grease;

from about 1 to 8 by weight polarized graphite; and effective amount of molybdenum disulfide.

23. A rock bit for drilling subterranean formations comprising:

a bit body including a journal pin having a bearing surface;

a cutter cone mounted on the journal pin and including a bearing surface;

a grease reservoir in communication with such bearing surfaces;

a grease composition in the grease reservoir and adjacent the bearing surfaces comprising:

a lubricating base oil;

sufficient thickener and additives in the base oil to form a rock bit grease;

molybdenum disulfide; and from about 1 to 8 percent by weight polarized graphite.

24. A rock bit according to claim 23 wherein the rock bit comprises a plurality of journal pins, each having a bearing surface, and a cutter cone mounted on each journal pin and including a bearing surface, wherein the grease reservoir is in communication with such bearing surfaces, and wherein the grease composition is adjacent the bearing surfaces.

25. A rock bit for drilling subterranean formations comprising:

a bit body including a journal pin having a bearing surface;

a cutter cone mounted on the journal pin and including a bearing surface;

a grease reservoir in communication with such bearing surfaces;

a grease composition in the grease reservoir and adjacent the bearing surfaces comprising:

a lubricating base oil;

sufficient thickener and additives in the base oil to form a rock bit grease; and from more than 6 percent by weight polarized graphite.

26. A rock bit according to claim 25 wherein the grease composition comprises no more than about 8% by weight polarized graphite.

27. A rock bit according to claim 25 wherein the rock bit comprises a plurality of journal pins, each having a bearing surface, and a cutter cone mounted on each journal pin and including a bearing surface, wherein the grease reservoir is in communication with such bearing surfaces, and wherein the grease composition is adjacent the bearing surfaces.

28. A rock bit for drilling subterranean formations comprising:

a bit body including a journal pin having a bearing surface;

a cutter cone mounted on the journal pin and including a bearing surface;

a grease reservoir in communication with such bearing surfaces; and a grease composition in the grease reservoir and adjacent the bearing surfaces comprising a substituted conventional rock bit grease composition in which polarized graphite is substituted for graphite and/or hexagonal boron nitride in an unsubstituted conventional rock bit grease composition on a one-for-one basis.

29. A rock bit according to claim 28 wherein the rock bit comprises a plurality of journal pins, each having a bearing surface, and a cutter cone mounted on each journal pin and including a bearing surface, wherein the grease reservoir is in communication with such bearing surfaces, and wherein the grease composition is adjacent the bearing surfaces.

30. A rock bit for drilling subterranean formations comprising;

a bit body including a journal pin having a bearing surface;

a cutter cone mounted on the journal pin and including a bearing surface;

a grease reservoir in communication with such bearing surfaces; and a grease composition in the grease reservoir and adjacent the bearing surfaces comprising a substituted conventional rock bit grease composition in which an effective amount of polarized graphite is substituted for graphite and/or hexagonal boron nitride in an unsubstituted conventional rock bit grease composition.

31. A rock bit according to claim 30 wherein the rock bit comprises a plurality of journal pins, each having a bearing surface, and a cutter cone mounted on each journal pin and including a bearing surface, wherein the grease reservoir is in communication with such bearing surfaces, and wherein the grease composition is adjacent the bearing surfaces.

* * * * *

UNITED STATES PATENT AND TRADEMARK OFFICE

CERTIFICATE OF CORRECTION

PATENT NO. : 7,121,365 B2
APPLICATION NO. : 10/744112
DATED : October 17, 2006
INVENTOR(S) : Denton et al.

It is certified that error appears in the above-identified patent and that said Letters Patent is hereby corrected as shown below:

In the Claims

| | |
|---|---|
| Column 17, line 30, Claim 7 | Delete "additives",<br>Insert --additive-- |
| Column 17, line 44, Claim 8 | Delete "70.degree.",<br>Insert --70°-- |
| Column 22, line 14, Claim 30 | Delete "comprising;",<br>Insert --comprising:-- |

Signed and Sealed this

Thirteenth Day of March, 2007

JON W. DUDAS
*Director of the United States Patent and Trademark Office*